US007926438B2

(12) United States Patent
Guerrero et al.

(10) Patent No.: US 7,926,438 B2
(45) Date of Patent: Apr. 19, 2011

(54) SUBSEA OPERATIONS SUPPORT SYSTEM

(75) Inventors: Julio C. Guerrero, Cambridge, MA (US); Pascal Panetta, Paris (FR); Hitoshi Tashiro, Kamakura (JP)

(73) Assignee: Schlumberger Technology Corporation, Cambridge, MA (US)

( * ) Notice: Subject to any disclaimer, the term of this patent is extended or adjusted under 35 U.S.C. 154(b) by 31 days.

(21) Appl. No.: 11/935,212

(22) Filed: Nov. 5, 2007

(65) Prior Publication Data

US 2009/0114140 A1 May 7, 2009

(51) Int. Cl.
*B63G 8/41* (2006.01)

(52) U.S. Cl. ..... 114/312; 114/322

(58) Field of Classification Search ..... 114/312–314, 114/322

See application file for complete search history.

(56) References Cited

U.S. PATENT DOCUMENTS

| | | | | |
|---|---|---|---|---|
| 3,454,083 | A * | 7/1969 | Brooks | 166/337 |
| 3,643,736 | A | 2/1972 | Talley | |
| 3,664,873 | A | 5/1972 | Buswell et al. | |
| 3,689,709 | A * | 9/1972 | Salmansohn et al. | 381/151 |
| 3,774,564 | A | 11/1973 | Bondon et al. | |
| 3,964,264 | A | 6/1976 | Tornabene | |
| 4,194,857 | A | 3/1980 | Chateau et al. | |
| 4,228,360 | A | 10/1980 | Navarro | |
| 4,255,068 | A | 3/1981 | Valantin | |
| 4,284,901 | A | 8/1981 | Giguere | |
| 4,363,569 | A | 12/1982 | Scodino et al. | |
| 4,672,222 | A | 6/1987 | Ames | |
| 5,042,959 | A | 8/1991 | Tadatsu | |
| 5,069,580 | A | 12/1991 | Herwig et al. | |
| 5,074,713 | A | 12/1991 | Reis | |
| 5,202,194 | A | 4/1993 | VanBerg, Jr. | |
| 5,235,931 | A | 8/1993 | Nadolink | |
| 5,314,762 | A | 5/1994 | Hamada et al. | |
| 5,372,617 | A | 12/1994 | Kerrebrock et al. | |
| 5,425,599 | A | 6/1995 | Hall et al. | |
| 5,579,285 | A | 11/1996 | Hubert | |
| 6,089,339 | A * | 7/2000 | Willis | 180/9.46 |
| 6,113,312 | A | 9/2000 | Nørholmen | |
| 6,223,675 | B1 * | 5/2001 | Watt et al. | 114/312 |
| 6,260,504 | B1 | 7/2001 | Moles et al. | |
| 6,438,957 | B1 | 8/2002 | Goldman | |
| 6,686,079 | B2 | 2/2004 | Zhang et al. | |
| 6,808,021 | B2 * | 10/2004 | Zimmerman et al. | 166/381 |
| 6,856,036 | B2 | 2/2005 | Belinsky | |
| D522,915 | S | 6/2006 | Bruckler | |
| 7,096,955 | B2 | 8/2006 | Zhang et al. | |
| 7,194,975 | B2 | 3/2007 | Potter et al. | |
| 2002/0040783 | A1 | 4/2002 | Zimmerman et al. | |
| 2005/0073154 | A1 * | 4/2005 | Dudley | 290/54 |

FOREIGN PATENT DOCUMENTS

| | | | |
|---|---|---|---|
| WO | 9951877 | A1 | 10/1999 |
| WO | 03070565 | A2 | 8/2003 |

* cited by examiner

*Primary Examiner* — Stephen Avila
(74) *Attorney, Agent, or Firm* — Brigid Laffey; Vincent Loccisano; James McAleenan

(57) ABSTRACT

An underwater operations support system facilitates underwater exploration, monitoring, maintenance and construction operations associated with development of natural resources. The operations support system may include energy generation subsystems, energy accumulation subsystems, communication subsystems, docking stations, repair and maintenance robots, housings for divers, and video subsystems. Supported equipment includes ROVs, HROVs, AUVs, and other autonomous and semi-autonomous mobile robots which move materials, perform manual tasks, and survey the environment. Operational efficiency is enhanced by recharging, repairing and reconfiguring vehicles, and transferring data and commands between vehicles and a control station, without moving the vehicle to and from the surface, and without need for a surface ship to remain on site for the duration of operations.

17 Claims, 2 Drawing Sheets

SUBSEA OPERATIONS SUPPORT SYSTEM

FIELD OF THE INVENTION

This invention is generally related to autonomous and semi-autonomous underwater operation of mechanical systems and robotic devices, and more particularly to providing logistical support for operation of the devices. Functions of the underwater operations support system can include providing energy and data transfer in support of tasks related to at least one of exploration, monitoring, maintenance, and construction operations.

BACKGROUND OF THE INVENTION

In order to recover natural resources from underwater subterranean formations it is often necessary to perform exploration, monitoring, maintenance and construction operations on or beneath the sea floor. In relatively shallow depths these tasks can be performed by divers. However, at greater depths, and also when conditions are dangerous at shallow depths, the tasks are generally performed by robotic devices. Various types of robotic devices are known. For example, a remotely operated vehicle (ROV) is a robotic device that functions under the control of an operator via an umbilical cable that connects the ROV with a surface ship. A somewhat similar device, known as an autonomous underwater vehicle (AUV), operates according to programming, without physical connection to a surface ship. Hybrid ROVs which can operate either autonomously or via a physical connection to a surface ship are also known. Generally, ROVs are characterized by relatively limited range because of the physical connection to the surface ship. However, an ROV can operate indefinitely because energy is supplied by the surface ship. AUVs are not range-limited by a physical connection to the surface, but cannot operate indefinitely because they tend to exhaust their storage batteries quickly, necessitating frequent trips to the surface for recharging. Another difference is that ROVs exchange data and commands with the surface ship via the umbilical cable, whereas AUVs exchange data and commands via wireless communications. While ROVs, AUVs and HROVs are capable of performing tasks which cannot be practically performed in a cost-effective manner by divers, the need for a surface ship to remain on station during operations is costly. In order to reduce operational costs a system capable of performing tasks with few or no human operators near the site would be desirable.

Considerable research has been done on the problems associated with recovery of undersea resources. The following are some examples. U.S. Pat. No. 3,643,736 entitled SUB SEA PRODUCTION STATION describes production of sub sea deposits through a satellite system. The system is not configured to support autonomous operations. U.S. Pat. No. 3,454,083 entitled FAIL-SAFE SUBSEA FLUID TRANSPORTATION SYSTEM describes a system for production of fluid minerals. The system includes a product gathering network having production satellites in which the gas-oil water ratios of each well are periodically tested and the flow rates are automatically controlled. U.S. Pat. No. 6,808,021 B2, entitled SUB SEA INTERVENTION SYSTEM, describes a system that is usable within sub sea wells that extend beneath the sea floor, including a station that is located on the sea floor and an underwater vehicle. The underwater vehicle is housed in the station and is adapted to service the sub sea wells. U.S. Pat. No. 4,194,857, entitled SUB SEA STATION, describes an installation in which one or more rigid elongated base template frames are adapted to be permanently positioned on a sea floor. Each base template frame has a receptor for other modules that carry equipment in a protected manner. U.S. Pat. No. 5,069,580, entitled PAYLOAD INSTALLATION SYSTEM, describes landing and securing a payload to a subsea assembly, such as hydrocarbon recovery assembly, utilizing a surface vessel and a sub sea ROV.

Other references related to underwater operations include the following. U.S. Pat. No. 4,255,068 entitled METHOD AND DEVICE FOR UNDERSEA DRILLING, describes boring a shaft in the sea floor to form a drilling station of sufficient size to accommodate personnel and equipment. U.S. Pat. No. 5,425,599, entitled METHOD FOR REPAIRING A SUBMERGED PIPELINE, describes repairing a damaged sub sea pipeline on the sea bed by lowering pipe support frames beneath the sub sea pipeline on each side of the damaged pipeline section using ROVs and sub sea cutters. Also described is the use of airbags activated by the ROVs that hold equipment and pipes during operations in the sub sea environment. U.S. Pat. No. 3,964,264, entitled WAVE-ACTION UNDERSEA-DRILLING RIG, describes transforming energy from sub sea water motion and using that energy to drive a drilling system. The system uses turbine-blade structures positioned and shaped such that water-current force on the turbine blade structures imparts a clockwise motion to the float. U.S. Pat. No. 5,372,617, entitled HYDROGEN GENERATION BY HYDROLYSIS OF HYDRIDES FOR UNDERSEA VEHICLE FUEL CELL ENERGY SYSTEMS, describes energy generation in closed systems such as undersea vehicles. A hydrogen generator for hydrolyzing hydrides substantially at stoichiometry to provide hydrogen on demand to a fuel cell is disclosed. The generator comprises a sealable, pressurizable, thermally insulated vessel into which a hydride in granular form is loaded. Water, most of which is a byproduct of the fuel cell, is controllably introduced into the vessel for reaction with the hydride to generate hydrogen. The rate of introduction of the water is determined by the demand for hydrogen at the fuel cell. Heat transfer apparatus is disposed about the vessel to control the temperature of the reaction. A stirring mechanism is disposed in the vessel to prevent clumping of the hydride, to distribute the water to unreacted hydride, and to disperse the heat of the reaction throughout the hydride mass and thence to the heat transfer apparatus. An outlet from the vessel is provided for transfer of the generated hydrogen to the fuel cell. U.S. Pat. No. 6,856,036 B2, entitled INSTALLATION FOR HARVESTING OCEAN CURRENTS, describes harvesting kinetic energy of ocean currents in deepwater utilizing a semi-submersible platform and vertically oriented Darrieus type hydraulic turbines with funnels. The turbines are located below sea level at a distance sufficient to exclude them from being affected by wave actions. The electric power generators are located on a structure above water and transmit electric power to the shore utilizing flexible cable from semi-submersible to the sea bottom and underwater cable going to the shore, where it connected to the power distributing network.

SUMMARY OF THE INVENTION

In accordance with one embodiment of the invention, apparatus for supporting underwater operation of robotic devices, comprises: an energy storage module operative to store energy, and to discharge stored energy on demand; an interface operable to temporarily connect the energy storage module with a robotic device, the robotic device receiving discharged stored energy from the energy storage module via the interface; and a communications device powered by the energy storage module, the communication device operable to provide a communication link between the robotic device and a surface station, the robotic device receiving instructions from the surface station and providing data to the surface station via the communications device. The docking station may transfer of power and data simultaneously.

In accordance with another embodiment of the invention, a method for supporting underwater operation of robotic devices comprises: storing energy in an energy storage module for discharge on demand; temporarily connecting the energy storage module with a robotic device via an interface, and discharging at least some of the stored energy from the energy storage module to the robotic device via the interface; and using energy from the energy storage module to power a communications device, providing a communication link between the robotic device and a surface station, the robotic device receiving instructions from the surface station and providing data to the surface station via the communications device.

An advantage of at least one embodiment of the invention is that performance of autonomous and semi-autonomous tasks associated with exploration, monitoring, maintenance and construction operations both nearby and beneath the sea floor can be undertaken without the continuous presence of divers or a nearby surface vessel during operations. Offshore operations are particularly costly because of the need of supporting manned vessels, i.e., surface ships or rigs, to be on or near the worksite. Some of the support tasks for which manned vessels have been required include bringing AUVs to the surface for recharge and data exchange, and remote operation of ROVs and HROVs. By providing both communications and energy recharge in the underwater environment in the vicinity of a worksite, the invention at least mitigates the need to keep manned vessels on site. Depending on the capabilities of the robotic vehicles supported by the system, some or most task may be completed without a manned vessel on site. Further, operations for which a manned vessel remains on site can be made more efficient by reducing the number of trips between the sea bottom and the surface for recharge, reconfiguration, and repair. It is advantageous to have a system capable of performing tasks on the sea floor without the need of the continuous presence of a manned vessel because having sub sea operations independent of sea surface hardware reduces operating costs.

Further features and advantages of the invention will become more readily apparent from the following detailed description when taken in conjunction with the accompanying Drawing.

DETAILED DESCRIPTION

Figure 1:
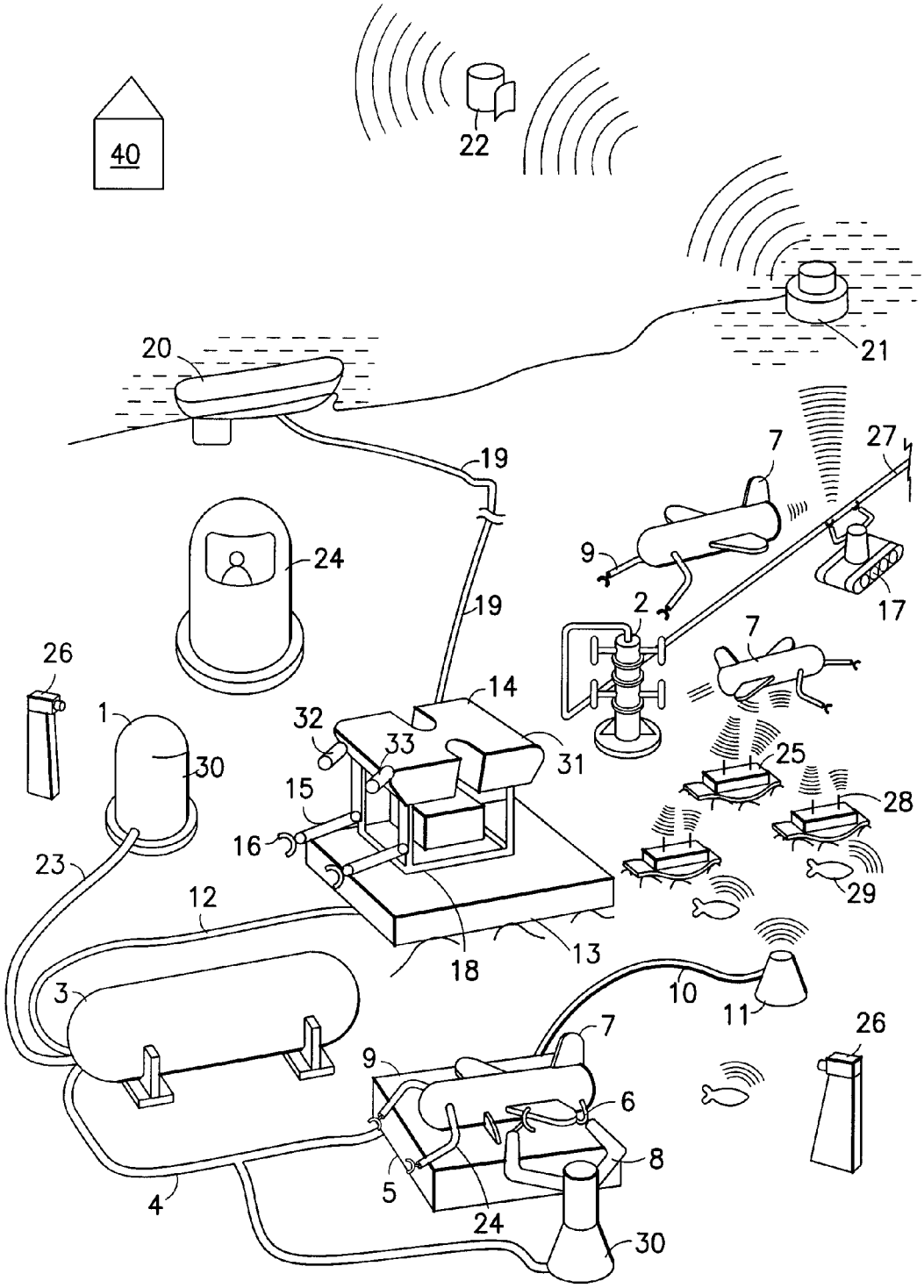
FIG. 1 illustrates an underwater operations support system.

FIG. 1 illustrates an underwater operations support system operable to support performance of autonomous and semi-autonomous tasks associated with exploration, monitoring, maintenance and construction operations both nearby and beneath the sea floor. In the illustrated embodiment, the system includes an energy accumulator (1), energy plant (3), docking stations (5, 13), communication station (11), communications buoy (21), high altitude communication relay device (22), maintenance robot (30), and various power transmission cables (4, 10, 12, 23). The system services robotic vehicles such as ROVs, HROVs, AUVs, and other equipment.

One of the functions of the underwater operations support system is providing energy for exploration, monitoring, maintenance and construction operations. The energy accumulator (1) is operative to store energy in accordance with any of various means, including but not limited to chemical and mechanical energy storage means. The stored energy may be discharged in any desirable form, including but not limited to electrical energy. The stored energy can be utilized, on demand, to operate the communication station (11) and any other equipment connected to the energy accumulator, such as the maintenance robot (30). The stored energy can also be used to recharge robotic devices that are not permanently connected to the energy accumulator. In the illustrated example, stored energy is transferred from the energy accumulator (1) to robotic vehicle (31), which may be an HROV, via power transmission cables (23, 12) and the docking station (13). Similarly, stored energy is transferred to AUV (7) via power transmission cables (23, 4) and docking station (5). The HROV (31) and AUV (7) have means to store a limited amount of power, such as batteries.

The energy plant (3) component is operable to provide energy to the energy accumulator (1) for storage. The energy plant may generate the energy from supplied fuel, or transform energy from the environment. For example, the energy plant (3) could include a fuel cell for generating energy. The energy plant could also include an internal combustion engine that uses fuel and oxygen, and transfers the exhaust fumes into a porous media inside the component, or an engine that utilizes an oxygenated fuel such as hydrogen peroxide. A nuclear-powered energy plant is another option for generating energy. Various techniques may be employed to transform energy from the environment, including but not limited to transforming kinetic energy from sub-sea currents into electrical energy. It should be noted, however, that the energy accumulator (1) may also be replenished from the surface. For example, the energy accumulator could include a large capacity battery or fuel storage tank configured to be either recharged in place, or recharged at the surface.

Another function of the underwater operations support system is providing communications support for exploration, monitoring, maintenance and construction operations. As previously mentioned, it is costly to keep divers and a surface ship in the vicinity of operations. A network is provided to enable operators at a remote land-based site (40) to control operations at the underwater site. The network includes a communications path between the underwater site, a land-based station, and the mother ship (20), including four different bi-directional communication links. A first link is established between the land-based station and a device (22) operating at high altitude, such as a communications satellite, aerostatic balloon or unmanned aerial vehicle. A second link is established between the high altitude device (22) and the surface retransmission module (21). The surface module (21), which is anchored to the sea floor and floats on the sea surface, is operative to relay signals between the high altitude device (22), mother ship (20), and communication station (11). The communication station (11) also communicates with equipment such as the robotic devices in the underwater environment. The communication links through the atmosphere may utilize electromagnetic signals, whereas the underwater communication links may utilize low frequency acoustic signals. The communication links are used to transmit commands from the land-based station and mother ship (20) to the robotic devices, and also to transmit data indicative of status of the operations and environmental conditions from the robotic devices to the land-based station and mother ship (20).

The docking station (13) facilitates the energy transfer and communications functions by establishing mechanical connection with a robotic device. A mechanical interface of the docking station (13) includes an anchoring component (18) that holds the robotic vehicle (31) (an ROV or HROV) in a secure position so that physical connections can be made for energy transfer and communications. Once the robotic vehicle is securely docked by the mechanical interface, the docking station provides energy to the robotic vehicle (if necessary), downloads stored data from the robotic vehicle, and uploads commands to the robotic vehicle. Robotic vehicle diagnostics may also be performed while the robotic vehicle is secured to the docking station. When energy and data transfer are complete, the docking station (13) launches the robotic vehicle. Docking station (5) facilitates performance of energy and data transfer operations for AUV type robotic vehicles in the same manner.

Another function of the underwater operations support system is maintaining and reconfiguring robotic devices. The maintenance robot (30) is operative to maintain and reconfigure other robotic devices that are secured in one of the docking stations (5, 13). The maintenance robot (30) is equipped with a maintenance end-effector (6) on a serial arm manipulator (8) to perform operations on other robots. The end-effector may be specialized for particular tasks, and the maintenance robot may be equipped with multiple end-effectors which can be mounted and utilized on demand so the functionality of the maintenance robot can be adapted to different needs. The serial arm manipulator (8) includes a number of parts which define its range of motion. The kinematic characteristics of the serial arm manipulator also defines the effective workspace. The serial manipulator may be reconfigurable for different operations.

The equipment serviced by the underwater operations support system performs autonomous and semi-autonomous exploration, monitoring, maintenance and construction operations both nearby and beneath the sea floor. In the illustrated example, at least one AUV (7) is provided for tasks such as deploying equipment, performing operations on equipment already placed on the sea bed, and monitoring performance of sensors and equipment. For example, the AUV could be used to install and maintain a blow out preventer (BOP) or Christmas tree (2). The AUV may be equipped with a serial arm manipulator (9) for assembling and disassembling equipment, and performing other manual operations. The serial arm manipulator may also be reconfigurable for different types of tasks. An ROV may be provided for tasks best suited to performance under direct control of an operator aboard a surface ship (20). The ROV is linked to the ship by an umbilical cable (19) (sometimes referred to as a tether). The umbilical is a group of cables that carry electrical signals back and forth between the surface ship (20) and the ROV. The ROV may also be supplied with hydraulic energy via the umbilical for tasks requiring high power. Most ROVs are equipped with at least one video camera and lights. Additional equipment may include sonar, magnetometers, camera (33), lighting lamps (32), a manipulator or cutting arm, water samplers, and instruments that measure water clarity, pressure, temperature, and other physical properties. The robotic vehicle (31), whether ROV or HROV, may be equipped with a manipulator arm, the number of parts of which define its degrees of freedom of motion. Manipulator are kinematic characteristics defines vehicles workspace relative to its position. The serial manipulator may be reconfigurable for different tasks. An end-effector (16) is disposed on the manipulator arm to provide specific functionality for completing tasks. In other words, the end-effector interacts directly with the equipment, while the manipulator places the end-effector in a suitable position to operate. A transportation module (17) may be provided to facilitate maintenance and configuration of robots. The transportation module is a mobile, modular device in which maintenance and configuration robots can be mounted and repositioned along the sea floor. An operators sub sea housing (24) may be provided to host operators, so they can directly monitor and control activities. Small sea bottom crawlers (25), which are robots that use biomimetics and thin film fluid mechanics in order to crawl on the sea floor to gather data with sensors, may also be provided. A transmitter (28) enables the sea bottom crawlers to communicate with the communication buoy (21). Sub sea cameras (26) may be provided to help monitor sub sea operations. Video data may be transmitted from the cameras (26) to the surface ship (20) and land-based station via the communications network. A sub sea deployment manipulator (27) may be provided to assemble and deploy heavy equipment on the sea floor. Small sea bottom swimmers (29), which are robots that use biomimetics to replicate fish in order to navigate close to the sea floor for data collection, may also be provided. Lighting (32) may be provided to help illuminated the area within range of the cameras (33).

Figure 2:
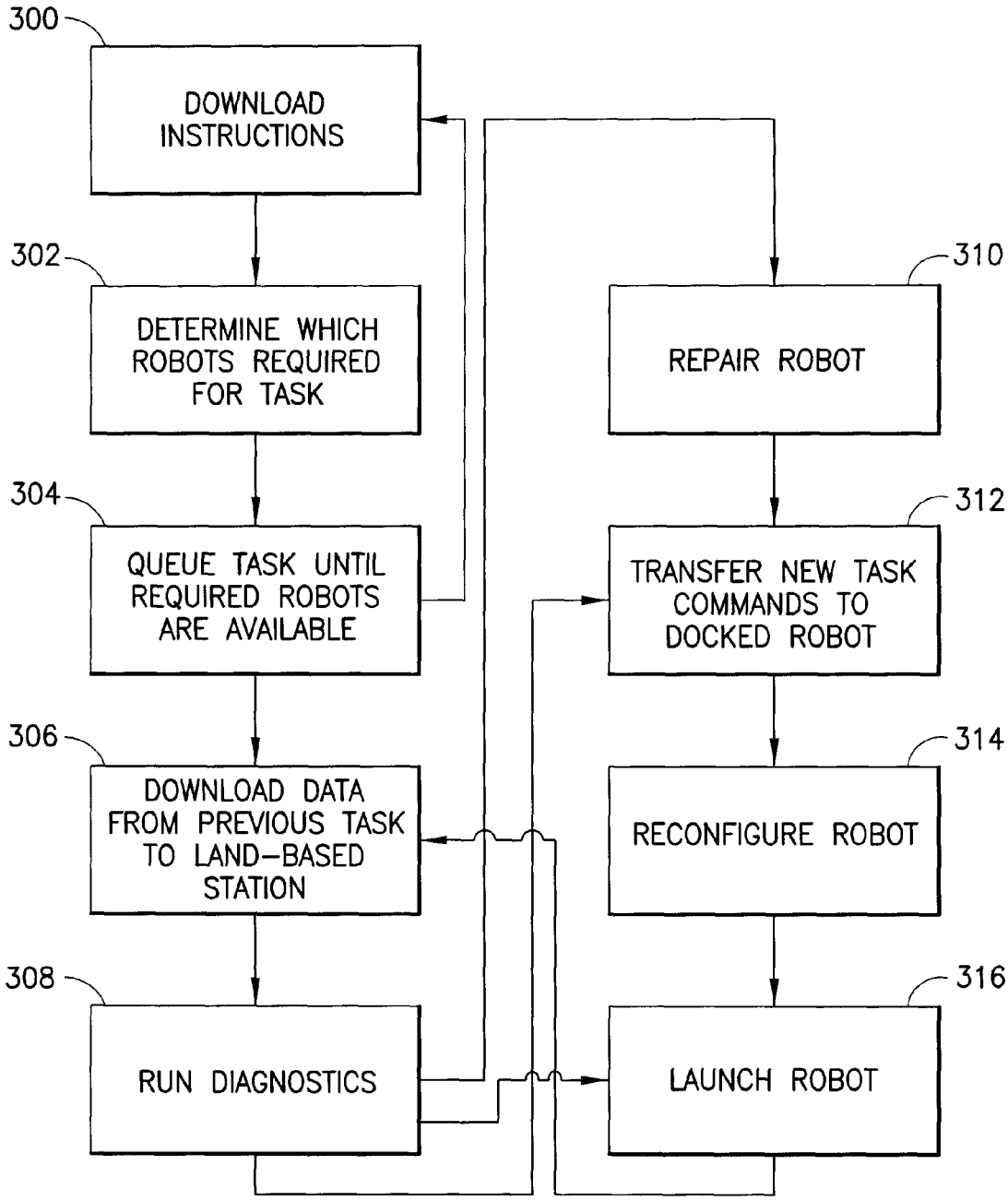
FIG. 2 illustrates a method for performing underwater exploration, monitoring, maintenance and construction operations.

FIG. 2 illustrates steps undertaken by the system depicted in FIG. 1 to perform operations on or about the sea floor. In step (300), instructions associated with a task to be performed are downloaded from the land-based station or surface ship (20) to the communication station (11). The communication station determined which robotic vehicles are required to complete the task in step (302). The task is then queued, based on priority, until the required robots are available as shown in step (304). At any given time the operators at the land-based station may not have an indication of the precise location of the AUVs. Further, multiple tasks of different priority may be queued. A decision is made, either by the communication station, land-based station, or both, as to which task to perform next based on task priority and available robotic vehicles. When a robotic vehicle, e.g., AUV (7), docks with the station (5), the vehicle is recharged by the energy accumulator (1) and the communication station (11) downloads data associated with the previous task from the robotic vehicle to the land-based station as shown in step (306). Diagnostic tests may then be run, as shown in step (308), to determine whether the robotic vehicle requires repairs. If the robotic vehicle does not require repairs, and has not completed the previous task, e.g., because the vehicle required recharge, the robotic vehicle is re-launched to continue work on the previous task as shown in step (316). If the diagnostics indicate a need for repair, the robotic vehicle is sent for repair as indicated by step (310). If the robotic vehicle does not require repair and the previous task is complete then commands associated with the next task in the queue are transferred into memory in the robotic vehicle as indicated by step (312). The robotic vehicle is then reconfigure for the new task, if necessary, as indicated by step (314). The recharged, reprogrammed and reconfigured robotic vehicle is then launched, as indicated by step (316). When the robotic vehicle returns to the docking station, data accumulated by the vehicle during operation is again transmitted to the land-based station via the communication station (11), as indicated by step (306). Instructions associated with new tasks may be downloaded while the robotic vehicle is working on another task, or docked. Thus, it should be appreciated that workflow may simultaneously proceed in multiple loops of the illustrated steps.

While the invention is described through the above exemplary embodiments, it will be understood by those of ordinary skill in the art that modification to and variation of the illustrated embodiments may be made without departing from the inventive concepts herein disclosed. Moreover, while the preferred embodiments are described in connection with various illustrative structures, one skilled in the art will recognize that the system may be embodied using a variety of specific structures. Accordingly, the invention should not be viewed as limited except by the scope and spirit of the appended claims.

What is claimed is:

1. Apparatus for supporting underwater operation of robotic devices, comprising:

an energy storage module operative to store and to discharge energy on demand;

an interface operable to temporarily connect the energy storage module with a robotic device, the robotic device receiving discharged stored energy from the energy storage module via the interface;

a communications device powered by the energy storage module, the communication device operable to provide a communication link between the robotic device and a surface station, the robotic device receiving instructions from the surface station and providing data to the surface station via the communications device;

an energy transformer operable to transform energy from the underwater environment into a different form, and to provide that transformed energy to the energy storage module; and wherein the communications device includes an acoustic transceiver operative to communicate with a surface module, the surface module being operative to communicate with the surface station via a high altitude communication device.

2. The apparatus of claim 1 wherein the interface includes a docking station via which both energy and communications are provided to the robotic devices.

3. The apparatus of claim 1 further including an energy generator operative to provide energy to the energy storage module.

4. The apparatus of claim 1 further including a maintenance robot operative to maintain the robotic device.

5. The apparatus of claim 1 further including a reconfiguration robot operative to reconfigure the robotic device.

6. The apparatus of claim 1 further including a transportation module for moving an immobile robotic device.

7. The apparatus of claim 1 further including an acoustic transceiver for establishing underwater wireless communication with a robotic device.

8. A method for supporting underwater operation of robotic devices, comprising:

storing energy in an energy storage module for discharge on demand;

temporarily connecting the energy storage module with a robotic device via an interface, and discharging at least some of the stored energy from the energy storage module to the robotic device via the interface;

using energy from the energy storage module to power a communications device, providing a communication link between the robotic device and a surface station, the robotic device receiving instructions from the surface station and providing data to the surface station via the communications device;

utilizing an energy transformer to transform energy from the underwater environment into a different form, and providing that transformed energy to the energy storage module; and further including the step of utilizing an acoustic transceiver operative to communicate with a surface module, the surface module being operative to communicate with the surface station via a high altitude communication device.

9. The method of claim 8 further including the step of securing the robotic device to a docking station via which both energy and communications are provided to the robotic device.

10. The method of claim 8 further including the step of providing energy to the energy storage module with an energy generator.

11. The method of claim 8 further including the step of directing a maintenance robot to maintain the robotic device.

12. The method of claim 8 further including the step of directing a reconfiguration robot to reconfigure the robotic device.

13. The method of claim 8 further including the step of moving an immobile robotic device with a transportation module.

14. The method of claim 8 further including the step of using wireless communication to communicate with a robotic device.

15. The method of claim 14 wherein an acoustic transceiver is utilized for establishing underwater wireless communication with the robotic device.

16. The apparatus of claim 1 wherein the underwater environment is a subsea environment.

17. The apparatus of claim 1 wherein the apparatus is located on or beneath a sea floor.

* * * * *